US005779225A

United States Patent [19]

Trost

[11] Patent Number: 5,779,225

[45] Date of Patent: Jul. 14, 1998

[54] SEMI-TRACTOR LIFTING CONNECTOR

[76] Inventor: James C. Trost, 12225-90th St. South, Hastings, Minn. 55033

[21] Appl. No.: 510,195

[22] Filed: Aug. 2, 1995

[51] Int. Cl.[6] ..... B66F 3/00

[52] U.S. Cl. ..... 254/133 R

[58] Field of Search ..... 254/1, 33, 34, 254/84, 131, 133 R, 135 A, 134, 419, 420, 2 B, 8 B, 100

[56] References Cited

U.S. PATENT DOCUMENTS

| | | | |
|---|---|---|---|
| 540,174 | 5/1895 | Maher et al. | 254/1 |
| 1,326,670 | 12/1919 | Korzagadrian | 254/133 R |
| 1,399,709 | 12/1921 | Holloway | 254/1 |
| 1,559,910 | 11/1925 | Peterson | 254/133 R |
| 2,124,314 | 7/1938 | Robison et al. | 254/1 |
| 2,649,933 | 8/1953 | Hecker | 254/133 R |
| 2,882,012 | 4/1959 | Luna | 254/133 R |
| 2,903,258 | 9/1959 | Jovanovich | 269/203 |
| 2,974,490 | 3/1961 | Hott | 254/2 B |
| 3,220,565 | 11/1965 | Wells | 254/134 |
| 3,300,183 | 1/1967 | Marshall, Jr. | 254/133 R |
| 3,680,837 | 8/1972 | Cestone et al. | 254/89 H |
| 4,640,495 | 2/1987 | Parsons | 254/134 |

*Primary Examiner*—Robert C. Watson
*Assistant Examiner*—Thomas W. Lynch
*Attorney, Agent, or Firm*—Mackall, Crounse & Moore, PLC

[57] ABSTRACT

This invention relates to a lifting connector for elevating the front end of a Freightliner® semi-tractor. The lifting connector removably attaches to a vehicle's front bumper and to a jacking mechanism. The lifting connector remains attached to the vehicle's front bumper while the jacking mechanism lifts the front portion of the vehicle. The lifting connector works to support the front bumper at a desired elevation with the aid of the jacking mechanism and/or jackstands.

12 Claims, 2 Drawing Sheets

SEMI-TRACTOR LIFTING CONNECTOR

BACKGROUND OF THE INVENTION

This invention relates to lifting connectors used for lifting and supporting semi-tractors by jacking mechanisms. Specifically this invention relates to lifting connectors for lifting a semi-tractor by the front bumper.

Semi-tractors must be elevated to allow a mechanic to work on the underside of the frame and/or engine. Usually, the front is lifted leaving the rear wheels on the ground. In the prior art, jacking mechanisms attach to the semi-tractor bumper or frame and lift until the front wheels are elevated. Alternatively, tractor jacking mechanisms are placed under the front wheel supports to lift the front of the semi-tractor. Jackstands are placed under the front wheel supports or the semi-tractor frame and the jacking mechanism lowered to allow the jackstands to support the tractor in an elevated position.

These prior art devices make servicing a semi-tractor difficult due to the space required for the jackstands. Furthermore the jacking mechanisms have potentially dangerous and awkward connections to the semi-tractor.

Some vehicles such as Freightliner® semi-tractors, for example, are equipped with a lifting slot formed in the front bumper. The front bumper also has a movable locking pin in the lifting slot. These lifting slots are used to raise and stack Freightliner® semi-tractors for shipment by attaching the semi-tractor front undercarriage to the fifth wheel device of another semi-tractor. In this manner, one semi-tractor may pull two or more semi-tractors which ride only on the rear wheels. The present invention is designed to use this lifting slot in a semi-tractor for connecting the front of a Freightliner® semi-tractor to a jacking mechanism for servicing or inspecting without the limitations of the prior art.

SUMMARY OF THE INVENTION

This invention relates to a lifting connector for elevating the front end of a Freightliner® semi-tractor. The lifting connector removably attaches to a vehicle such as a vehicle's front bumper and a jacking mechanism, stays attached to the vehicle while the jacking mechanism lifts the front of the vehicle, and supports the front bumper at a desired elevation with the jacking mechanism and/or jackstands.

A feature of the invention is a removable lifting connector secured to a lifting slot in the front bumper of a semi-tractor.

Another feature of the invention is a lifting connector which simultaneously accommodates a jacking mechanism to lift and a stationary jackstand to support the front of the vehicle at the desired elevation. A further feature of the connector is a spreader bar which will accommodate two jackstands for support of the front end of the semi-tractor.

An advantage of the present invention is a device which supports the front of a vehicle without jackstands directly under the vehicle. Another advantage of the present invention is increased work space under the vehicle the lifting connector connects the front of the vehicle to jackstands.

A further advantage of the present invention is a removable lifting connector that does not require modification of a vehicle to be lifted.

Another advantage of the present invention is a lifting connector which is transportable and independent of the jacking mechanism.

DETAILED SPECIFICATION

Figure 1:
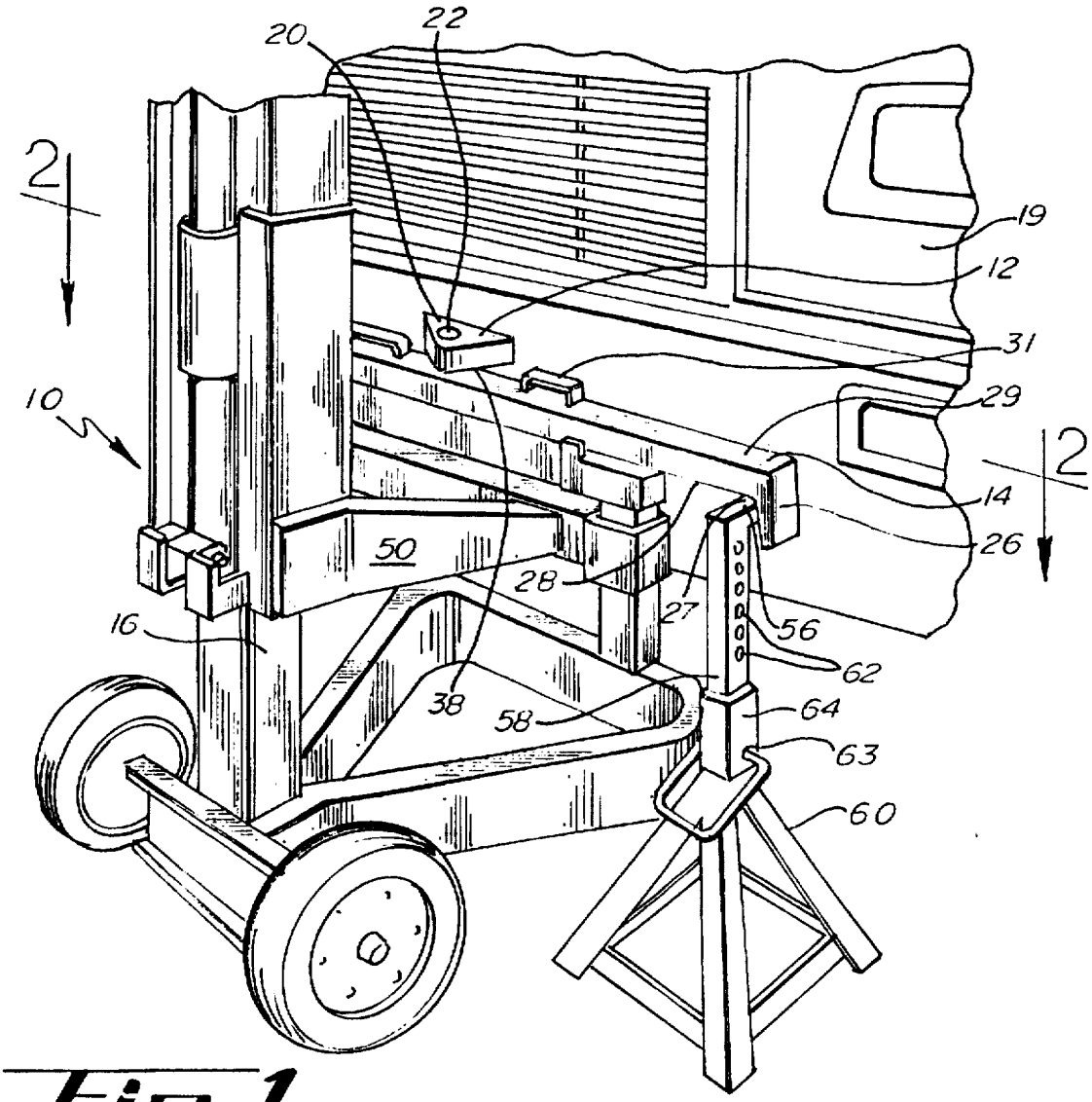
FIG. 1 s a perspective view of the lifting connector attached to the front bumper of a Freightliner® semi-tractor.

FIG. 1 shows the lifting connector indicated in general by the numeral 10. Lifting connector 10 includes a tongue 12, and spreader bar 14. A heavy duty jacking mechanism 16 is connected to an object to be lifted by the lifting connector 10. The lifting connector 10 connects jacking mechanism 16 to a variety of objects such as cars, trailers or other vehicles. To illustrate the utility of the present invention, the lifting connector 10 is described in use with a Freightliner® semi-tractor 19. The description of the lifting connector 10 in use with a Freightliner® semi-tractor 19 as illustrative and not meant to limit the scope of the invention. Lifting connector 10 engages the front bumper 18 of a Freightliner® semi-tractor 19 at lifting slot 20.

Figure 2:
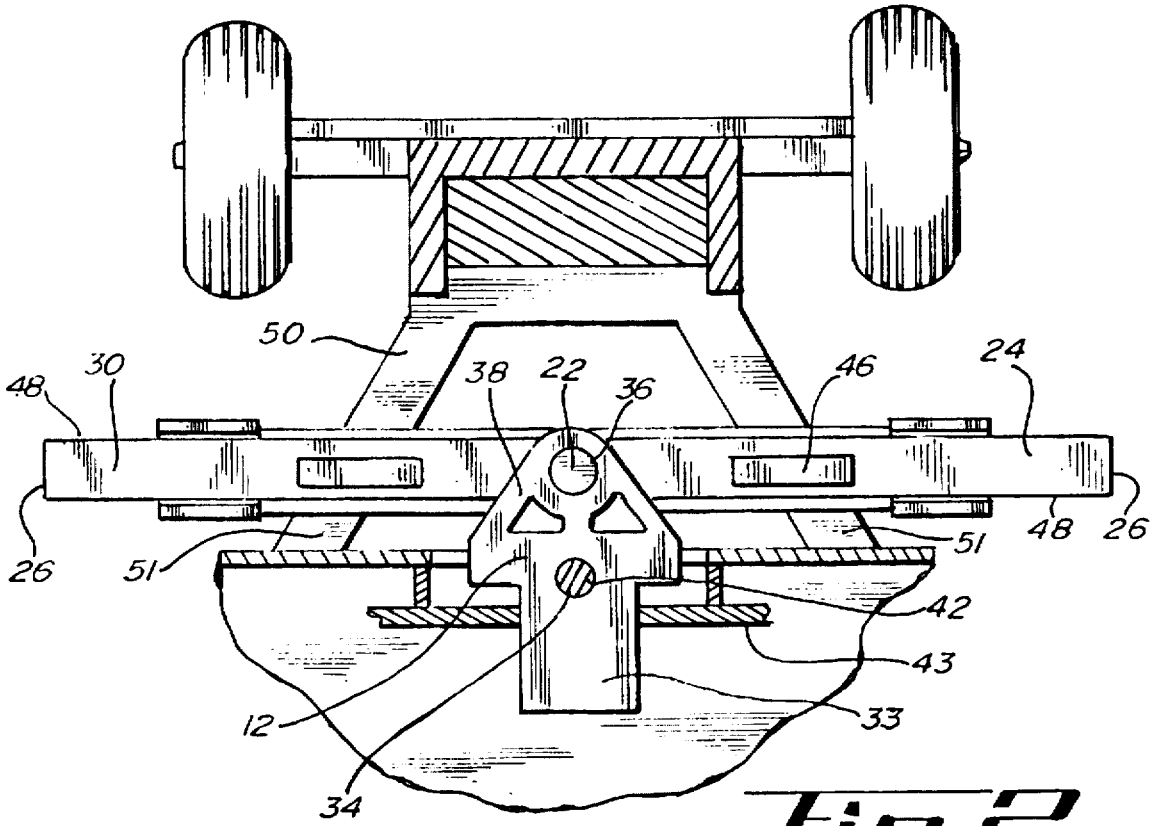
FIG. 2 is a detail section view taken at approximately 2—2 of FIG. 1 specifically illustrating the lifting connector.
Figure 4:
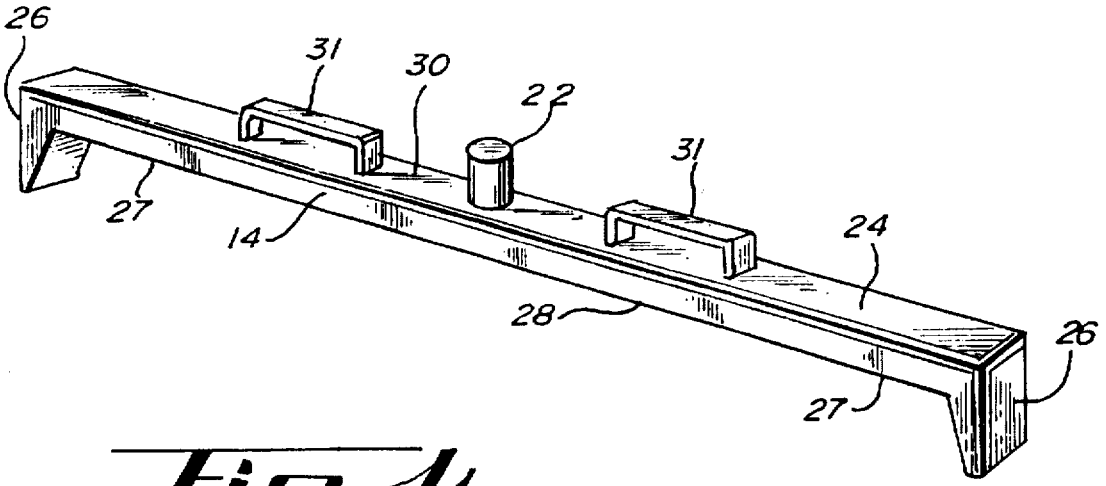
FIG. 4 is a perspective view of the spreader bar.

As seen in FIGS. 1 and 4, spreader bar 14 comprises lift post 22 welded onto square tube 24. Jackstand tabs 26 are welded onto square tube 24 at both ends of spreader bar 14 and extend from bottom wall 28 of square tube 24. Jackstand seat 27 is formed along the bottom wall 28 adjacent jackstand tabs 26. In the preferred embodiment as shown in FIGS. 1 and 2, lift post 22 comprises a barrel shaped member welded onto top wall 30 of square tube 24 intermediate jackstand tabs 26. Carrying handles 31 are attached to top wall 30 between lift post 22 and jackstand tabs 26. Square tube 24 has a length sufficient to securely connect jacking mechanism 16 to vehicle. Spreader bar 14 engages vehicle with top wall 30, lift post 22 or in cooperation with tongue 12.

As seen in FIG. 2, tongue 12 has an elongate rectangular vehicle bumper lever 33 to engage vehicle 19. Tongue 12 further comprises a locking pin aperture 34 and a lifting hole 36 in the preferred embodiment. Lifting hole 36 has an inside diameter sufficient to accept lift post 22 therein. Tongue 12 has a lifting member 38 adjacent lift hole 36.

Figure 3:
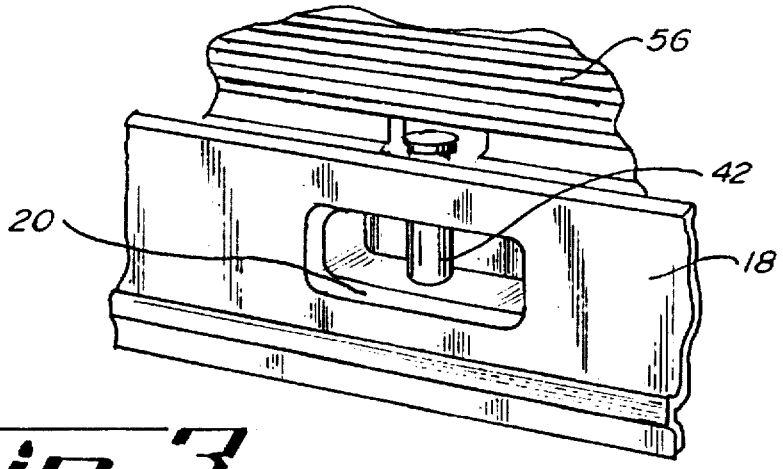
FIG. 3 is a perspective view of the lift slot in the front bumper of a Freightliner® semi-tractor.

As seen in FIG. 3, a Freightliner® semi-tractor 19 has a slot 20 and a vertically movable locking pin 42 within lifting slot 20. Locking pin 42 is cylindrical in shape and has an outside diameter less than the inside diameter of locking pin aperture 34. Vehicle bumper lever 33 has a thickness less than the height of lift slot 20 and a width less than the width of slot 20. To connect tongue 12 to bumper 18, vehicle bumper lever 33 is inserted in lifting slot 20 and locking pin aperture 34 aligned with locking pin 42. Locking pin 42 is vertically moved into locking pin aperture 34 to retain tongue 12. Locking pin 42 retains vehicle bumper lever 33 in lifting slot 20. Bumper lever bears against frame members 43 as shown in FIG. 2.

Jacking mechanism 16 is a commercially available heavy duty air jacking mechanism. Jacking mechanism 16 comprises hoist support 50 which is vertically movable. Hoist support progressively elevates and lowers the semi-tractor 19 by the front bumper 18. Hoist support 50 has lifting arms 51 which engage spreader bar 14 on bottom wall 28. It should be understood that jacking mechanism 16 may alternatively be a hydraulic or electric powered lifting means such as a forklift or crane. Spreader bar 14 must have a length sufficient to extend over lifting arms 51 to balance the weight of vehicle and engage jackstands 54 at jackstand seat 27.

In operation, the locking pin 42 is vertically moved into the nonlocking position out of lift slot 20. Vehicle bumper lever 33 is placed in lifting slot 20 aligning locking pin aperture 34 with locking pin 42. Locking pin 42 is moved vertically into locking pin aperture 34 to retain tongue 12 in lifting slot 20.

Spreader bar 14 is placed on hoist support 50 using handles 31 so lift post 22 is extending upward from spreader bar 14. Jacking mechanism 16 is positioned in front of bumper 18 to align lift post 22 with lifting hole 36. Hoist support 50 is raised to insert lift post 22 in lifting hole 36 and cause spreader bar 14 to engage and bear against lifting member intermediate the ends of the spreader bar 14.

Jacking mechanism 16 raises hoist support 50 to urge spreader bar 14 to bear against tongue 12 and lift the front of semi-tractor 19. When the desired elevation of bumper 18 is reached, jackstands 54, having a tripod base 55, are placed at either end of spreader bar 14. The elevation of jackstand plate 56 on spindle 58 is adjustable by removing pin 60. Alternate pin hole 62 in spindle 58 is aligned with sleeve hole 63 in jackstand sleeve 64. Pin 60 is inserted in alternate pin hole 62 through sleeve hole 63 to hold jackstand plate 56 at the desired elevation. Jackstand plate 56 is positioned at jackstand seat 27 adjacent jackstand tabs 26. It should be understood that jackstands 54 are adjusted so spreader bar 14 is supported in a horizontal position.

Jackstands 54 support spreader bar 14 and vehicle 19 to jacking mechanism 16 away from semi-tractor 19. Jacking mechanism 16 lifts spreader bar off jackstands 54 when the vehicle 19 is to be lowered. Jackstands 54 are moved and semi-tractor 19 is lowered by jacking mechanism 16.

Upon completion of work on the semi-tractor 19, jacking mechanism 16 is returned to engage spreader bar 14 with hoist support 50. Hoist support 50 is elevated causing spreader bar 14 to disengage jackstands 54. Jackstands 54 are removed and jacking mechanism 16 lowers hoist support 50 until semi-tractor 19 is resting on its wheels (not shown) and spreader bar 14, supported by hoist support 50, disengages tongue 12. Locking pin 42 is then vertically moved out of locking pin aperture 34 and vehicle bumper lever 33 is removed from lift slot 20.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A lifting connector for use with a jacking mechanism to facilitate connecting to a semi-tractor, said semi-tractor having a lifting slot and a locking pin, said lifting connector comprising a spreader bar having two ends and a top wall, a lifting post on the top wall, a tongue having a locking pin aperture and a lifting hole therein, said tongue receivable within said lifting slot and removably secured therein by insertion of said locking pin through said lifting slot and through said locking pin aperture, the lift post removably mounted in the lifting hole whereby the lifting connector engages the semi-tractor to be lifted and the jacking mechanism.

2. The invention of claim 1 wherein the spreader bar further comprises a jackstand seat adjacent each end of the spreader bar.

3. The invention of claim 2 wherein the jackstand seat further comprises a jackstand tab welded on each end of the spreader bar and extending from the spreader bar.

4. The invention of claim 2 wherein the lifting connector further comprises a jackstand engaging each jackstand seat whereby the spreader bar is supported at a predetermined elevation.

5. The invention of claim 1 wherein the spreader bar further comprises a carry handle adjacent the lift post.

6. A lifting connector for connecting a jacking mechanism having a hoist support to a vehicle, the vehicle having a front bumper, comprising:

(a) a tongue having a lifting member and a vehicle bumper lever that engages the front bumper of the vehicle;

(b) a spreader bar having two ends, the spreader bar bearing against the lifting member, whereby the tongue engages the vehicle and the jacking mechanism engages the spreader bar to thereby progressively elevate and lower the front bumper of the vehicle; and (c) a lift post on the spreader bar, a lifting hole in the lifting member, and the lift post removably mounted in the lifting hole.

7. A lifting connector for connecting a jacking mechanism to a vehicle's front bumper in combination with a lifting slot in the front bumper having a locking pin therein comprising:

(a) a tongue having a vehicle bumper lever removably mounted in the lifting slot, a lifting member on the tongue adjacent the front bumper having a lifting hole, the lifting member extending from the front bumper; and (b) a spreader bar having two ends, a top wall and a bottom wall, a lift post on the top wall intermediate the two ends, the lift post removably mounted in the lifting hole, the spreader bar bearing against the tongue whereby the jacking mechanism engages the spreader bar to progressively elevate and lower the vehicle by the front bumper.

8. The invention of claim 7 wherein the spreader bar further comprises a handle welded on the spreader bar intermediate the lift post and one end of the bar.

9. The invention of claim 7 wherein the spreader bar further comprises a jackstand tab welded to each end of the bar, the jackstand tab extending from the bottom wall.

10. The invention of claim 9 wherein the lifting connector further comprises a jackstand supporting the spreader bar adjacent one of the jackstand tabs, whereby the jackstand supports the spreader bar, tongue and front bumper at a predetermined elevation.

11. The invention of claim 7 wherein the lifting connector further comprises a jackstand seat adjacent each end of the spreader bar.

12. The invention of claim 7 wherein the lifting connector further comprises a locking pin aperture in the vehicle bumper lever, the locking pin removably inserted in the locking pin aperture, whereby the tongue is removably connected to the front bumper and retained by the locking pin.

* * * * *